US007036257B1

(12) United States Patent
Sardo

(10) Patent No.: US 7,036,257 B1
(45) Date of Patent: May 2, 2006

(54) DECORATIVE HOLIDAY PICTURE FRAME COVER

(76) Inventor: Louis Sardo, 512 W. Rosecrans Ave., Gardena, CA (US) 90248

( * ) Notice: Subject to any disclaimer, the term of this patent is extended or adjusted under 35 U.S.C. 154(b) by 158 days.

(21) Appl. No.: 10/781,089

(22) Filed: Feb. 18, 2004

Related U.S. Application Data

(60) Provisional application No. 60/506,584, filed on Sep. 26, 2003.

(51) Int. Cl.
*A47G 1/06* (2006.01)

(52) U.S. Cl. ..... 40/798; 40/714; 40/717; 40/455; 362/154; 428/40.1; 229/87.03; 84/600

(58) Field of Classification Search ..... 84/600; 428/40.1; 340/396.1; 412/3; 40/788; 229/87.19, 229/87.03; 362/154; 383/75
See application file for complete search history.

(56) References Cited

U.S. PATENT DOCUMENTS 488,630 A 12/1892 Hafely
5,392,983 A * 2/1995 Clarke-Bolling et al. 229/87.19
5,513,455 A 5/1996 Walker ..... 40/788
5,529,395 A * 6/1996 French ..... 383/75
5,743,458 A * 4/1998 French ..... 229/87.03
5,774,041 A 6/1998 Xydis ..... 340/396.1
6,472,038 B1 * 10/2002 Murphy ..... 428/40.1
2002/0136004 A1 * 9/2002 Rudoy ..... 362/154

* cited by examiner

*Primary Examiner*—Rina Duda
*Assistant Examiner*—Christina Russell
(74) *Attorney, Agent, or Firm*—Goldstein Law Offices P.C.

(57) ABSTRACT

A decorative holiday picture frame cover, for use in conjunction with an existing picture frame having a front, sides, a rear, and a border defining a window at the front. The picture frame cover has a front panel, and a stretchable rear edging. The picture frame cover is fitted onto the frame by extending the rear edging behind the rear of the frame and engaging the sides of the frame with the edging, thereby causing the front panel to extend over the front of the picture frame, and to cover the window of the picture frame. The front panel has the appearance of gift wrap paper and has an attractive bow thereon so that the picture frame is given the appearance of a wrapped gift.

6 Claims, 3 Drawing Sheets

DECORATIVE HOLIDAY PICTURE FRAME COVER

CROSS REFERENCES AND RELATED SUBJECT MATTER

This application is a continuation in part of provisional patent application Ser. No. 60/506,584 filed in the United States Patent Office on Sep. 26, 2003.

BACKGROUND OF THE INVENTION

1. Field of the Invention

The invention generally relates to a frame cover, and in particular it relates to a decorative holiday picture frame cover that temporarily attaches onto a conventional picture frame to give it the appearance of a wrapped gift.

2. Description of the Related Art

During a holiday season, people often adorn rooms within their homes and places of business with various decorations. For example, during the Christmas season, holiday lights, spray-on snow, lighted figurines, and nativity scenes may be used to adorn a room, and thereby convert an "ordinary" room into one having a decor which evokes the "Christmas spirit". An existing room generally has one or more picture frames for displaying paintings, photographs, and the like. These picture frames, and the pictures contained therein, often do little to enhance the holiday decor of the room in which they are situated, and may even detract from the theme of the particular holiday at hand. For example, a picture frame displaying a picture of a barren desert would detract from a Christmas holiday theme, which generally is evocative of a snowy, "white" Christmas. Accordingly, there is a need for a decorative holiday picture frame cover that is temporarily fitted onto an existing picture frame, for obscuring the picture contained therein, and for giving the picture frame the appearance of a wrapped gift, in order to enhance the holiday decor of the room in which the picture frame is situated.

A great many decorative covers have been devised for wrapping a variety of existing articles. For example, U.S. Pat. No. 5,743,458 to French discloses a stretchable gift-wrap for wrapping a portion of an existing article. Additionally, U.S. Pat. No. 5,392,983 to Clarke-Bolling et al. discloses a reusable fabric gift wrapping, comprising a washable fabric sheet which is secured during wrapping by a resealable adhesive coating. Furthermore, U.S. Pat. No. 5,513,455 to Walker discloses a system for providing a collapsible display constructed of a pliable foldable material. Moreover, U.S. Pat. No. 6,472,038 to Murphy discloses a decorative frame cover that selectively covers a border of an existing frame with different coverings, having an opening for viewing the picture within the picture frame.

While these devices may be suitable for the particular purpose employed, or for general use, they would not be as suitable for the purposes of the present invention as disclosed hereafter.

SUMMARY OF THE INVENTION

It is an object of the invention to provide a picture frame cover that provides a holiday decorative appearance to an existing picture frame. Accordingly, the frame cover has a front panel having the appearance of wrapping paper. The front panel extends over the front surface of the existing picture frame, and thereby provides a holiday decorative appearance.

It is another object of the invention to provide a picture frame cover that provides the appearance of a wrapped gift. Accordingly, an elegant bow is affixed to the front panel of the picture frame cover, and thereby provides the appearance of a wrapped gift.

It is a further object of the invention to provide a picture frame cover that is easily and temporarily attachable onto a picture frame. Accordingly, the picture frame cover has a rear edging that stretches to extend over the frame sides and behind the frame, and thereby holds the front panel of the picture frame cover securely against the front of the frame. The picture frame cover does not actually affix to the picture frame, does not damage the picture frame, and may be easily removed from the picture frame after the holiday season.

The invention is a decorative holiday picture frame cover, for use in conjunction with an existing picture frame having a front, sides, a rear, and a border defining a window at the front. The picture frame cover has a front panel, and a stretchable rear edging. The picture frame cover is fitted onto the frame by extending the rear edging behind the rear of the frame and engaging the sides of the frame with the edging, thereby causing the front panel to extend over the front of the picture frame, and to cover the window of the picture frame. The front panel has the appearance of gift wrap paper and has an attractive bow thereon so that the picture frame is given the appearance of a wrapped gift.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
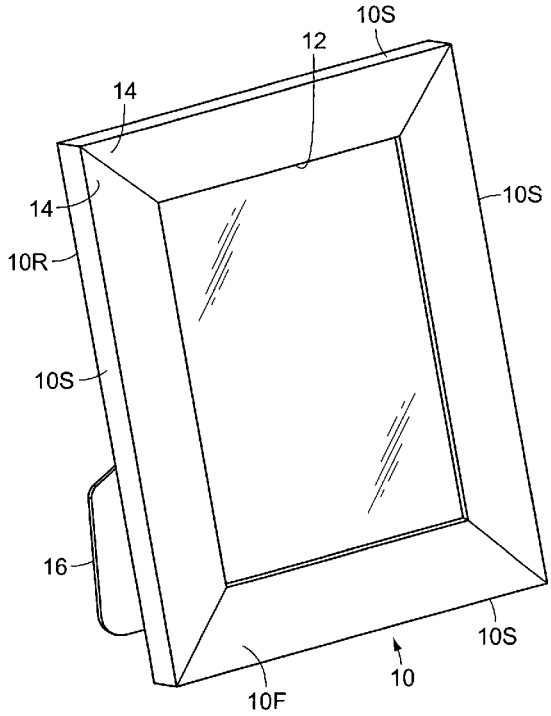
FIG. 1 is a perspective view of an existing picture frame.

FIG. 1 illustrates an existing picture frame 10, having a front 10F, a rear 10R, sides 10S, and a window 12 that is defined by a border 14 that extends inwardly at a substantially uniform width from the sides 10S. The picture frame 10 is substantially rectangular. Typically, a picture is displayed through the window 12 and is matted by the border 14. The picture frame 10 has a support arm 16 mounted to the rear 10R that is selectively deployable to allow the picture frame 10 to be free-standing upon an existing horizontal support structure such as a shelf or a table.

Figure 2:
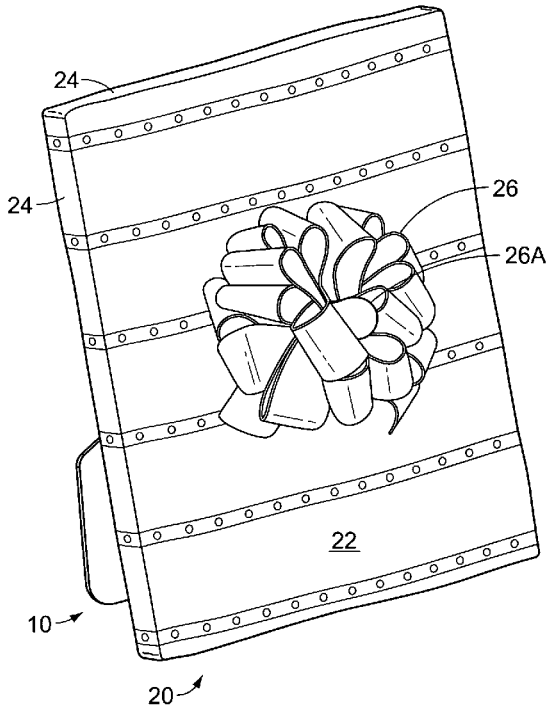
FIG. 2 is a perspective view of a decorative holiday picture frame cover after it has been installed upon the picture frame.

FIG. 2 illustrates a decorative holiday picture frame cover 20 after it has been temporarily installed upon the picture frame 10. The frame cover 20 has a substantially rectangular front panel 22, side panels 24, and an elegant bow 26 affixed to and centered upon the front panel 22. The bow 26 has a plurality of folds. The frame cover 20 has the appearance of gift wrapping paper. The picture frame cover 20 is provided in a wide variety of design and colors, in order that it may be used to complement the decor of any room in which it is being deployed to cover a picture frame 10. In particular, the picture frame cover 20 is adorned with designs that are evocative of a particular holiday "theme". Moreover, the picture frame cover 20 is provided in a wide variety of shapes and sizes, in order that it may be used to cover picture frames 10 having a wide variety of shapes and sizes. For example, a substantially circular picture frame cover 20 having a single arcuate side panel 24, is provided for use in conjunction with an existing substantially circular picture frame 10. As illustrated, the picture frame cover 20 substantially provides the appearance of a wrapped gift.

The bow 26 is optionally provided with at least one selectively blinking light 26A, and the frame cover 20 has a music player for playing the popular song "Jingle Bells" or other holiday theme music. The music player is small and may be hidden within the folds of the bow 26. The at least one blinking light 26A and the music player are in electrical communication with, and are selectively activated by either a motion sensor or a sound sensor. The sound sensor is activated by sound waves, including those produced by an individual who is clapping his/her hands together. The motion sensor is activated upon detection of motion. In yet another embodiment, the frame cover 20 is provided with a "light sensor" which is activated upon detection of light, and which in turn causes the light bulb to be selectively activated.

Figure 3:
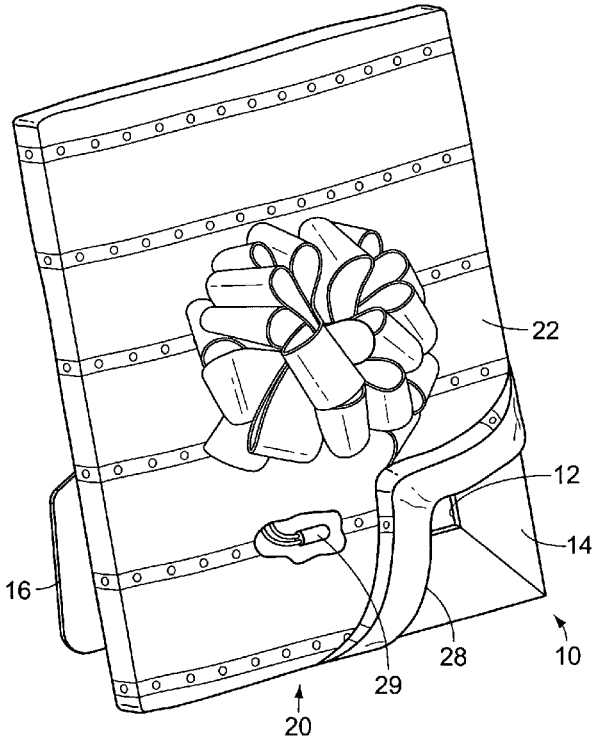
FIG. 3 is a perspective view, similar to FIG. 2, except that a corner of the frame cover has been peeled upward to reveal a stretchable rear edging thereof.
Figure 4:
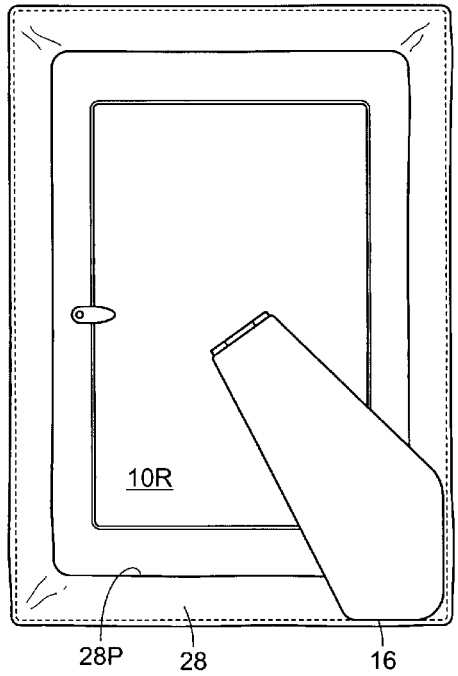
FIG. 4 is a rear elevational view of the picture frame with the stretchable rear edging fully seated thereon.

Referring to FIG. 3 and FIG. 4, the frame cover 20 has a stretchable rear edging 28 having a peripheral border 28P which extends inwardly from the side panels 24 behind the front panel 22. When the frame cover 20 is installed over the frame 10, the rear edging 28 stretches to conform to the contours and thickness of the picture frame 10, and the peripheral border 28P rests against the rear 10R of the frame 10 to hold the front panel 22 snugly against the frame front 10F. The cover 20 does not actually affix or adhere to the picture frame 10. Accordingly, the frame 10 is not marred or damaged in any way by the use of the cover 20. Once fully installed, the front panel 22 spans across and fully obscures the window 12 as well as the border 14 of the frame 10. As seen in FIG. 4, prior to fitting the cover 20 onto the frame 10, the support arm 16 should be pivoted away from the rear 10R of the frame 10, so that the support arm 16 will not be covered by the edging 28. The rear edging 28 comprises a stretchable material, chosen from a group of materials including spandex, elastic, and stretchable natural materials such as cotton, in order that it may conform to the dimensions of the particular picture frame 10 it is being used to "gift wrap".

Figure 5:
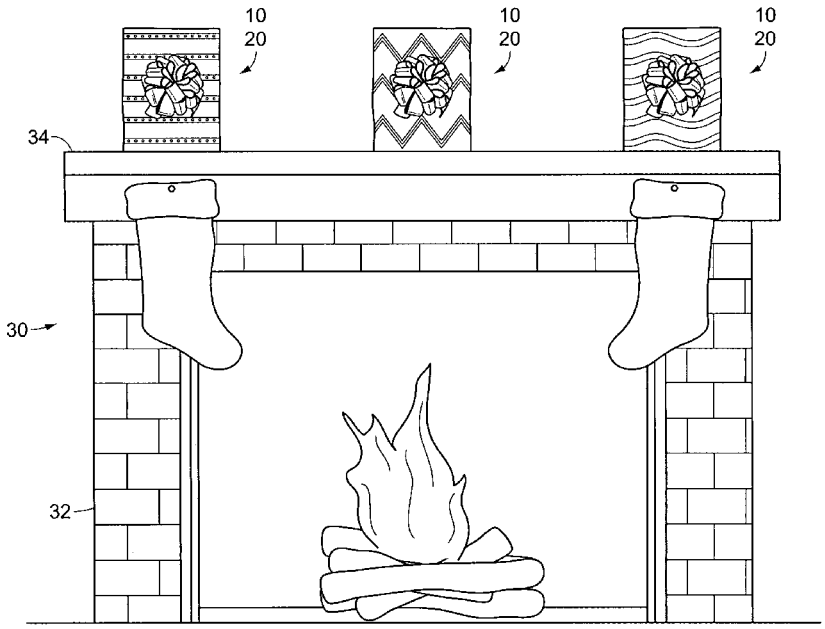
FIG. 5 is a front elevational view of a fireplace and mantle, wherein a picture frame cover has been installed onto each of the picture frames that are situated upon the mantle.

FIG. 5 illustrates an existing fireplace 32 and mantle 34, being used to furnish an attractive holiday display 30. In particular, several frames 10 are situated upon the mantle 34 and have been selectively covered with the frame covers 20. It should be noted that such a holiday display 30 may also be produced by using the frame covers 20 with wall-mounted picture frames 10. After the holiday season, the cover 20 is easily removed by simply pulling the cover 20 off the frame 10, by pulling the front panel 22 upwardly and away from the frame 10, so that the rear edging 28 disengages the picture frame sides 10S.

In an alternate embodiment, referring to FIG. 3, the frame cover 20 is provided with a backlighting bulb 29, which is another small light bulb, and the front panel 22 is constructed from a fabric which becomes substantially transparent when backlit. (In the theatrical profession, fabric with this quality is referred to as "scrim"). In such an embodiment, said backlighting bulb extends behind the front panel, so that it fits between the front panel 22 and the picture within the window 12 of the frame 10, and "back lights" the picture, thereby enabling a viewer to view the picture through the front panel. The frame cover 20 is provided with a "motion sensor" which is activated upon detection of motion, and which in turn causes the light bulb to be selectively activated. In use, the frame cover 20 is selectively fitted onto the frame 10 by extending the front panel 22 in front of the picture frame, thereby spanning the frame front 10F and substantially aligning the side panels 24 with the sides 10S of the frame. The rear edging 28 is stretched over the sides 10S to extend behind the frame 10. When released, the rear edging 28 engages the sides 10S of the frame 10, thereby causing the peripheral border 28P of the rear edging 28 to rest flush against the rear 10R of the frame 10, and the front panel 22 to fit snugly against the frame front 10F. Accordingly, the frame cover 20 stretches to conform to the contours and thickness of the particular picture frame 10 onto which it has been selectively installed. If the picture frame 10 has a support arm 16 for selectively supporting the frame 10 upon a horizontal surface, the support arm 16 is pivoted away from the rear 10R of the frame 10 prior to installing the frame cover 20 over the sides 10S of the picture frame 10, so that the support arm 16 will not be covered by the edging 28. After the holiday is over, the cover 20 is easily removed from the picture frame 10 by pulling the front panel 22 upwardly and away from the frame 10, so that the rear edging 28 disengages the picture frame sides 10S. The frame cover 20 may now be stored until needed for the next holiday season.

In conclusion, herein is presented a decorative picture frame cover that temporarily attaches onto a conventional picture frame to give it the appearance of a wrapped gift. The invention is illustrated by example in the drawing figures, and throughout the written description. It should be understood that numerous variations are possible, while adhering to the inventive concept. Such variations are contemplated as being a part of the present invention.

What is claimed is:

1. A decorative holiday picture frame cover, for use in conjunction with an existing rectangular picture frame, for temporarily attaching onto the picture frame to give it the appearance of a wrapped gift, said picture frame having a front, a rear, sides, and a window that is defined by a border that extends inwardly at a substantially uniform width from the sides, wherein an existing picture is displayed through the window and is matted by the border, comprising:

a front panel having a periphery, the front panel substantially rectangular and having the appearance of gift wrapping paper, for spanning across and fully obscuring the window as well as the border of the picture frame after the picture frame cover has been installed onto the picture frame;

side panels attached to the periphery;

a music player:

a bow affixed to and centered upon the front panel and having a blinking light;

a stretchable rear edging extending inwardly from the side panels, behind the front panel, and having a peripheral border, wherein the rear edging selectively stretches to conform to the contours and thickness of the picture frame in order to be fitted onto the picture frame, and wherein the stretchable rear edging comprises a material chosen from a class of materials including spandex, elastic, and stretchable cotton fabric, wherein it conforms to the dimensions of the particular picture frame it is being used to cover wherein the peripheral border selectively rests against the rear of the frame to hold the front panel snugly against the front of the frame;

a sensor chosen from a group of sensors consisting of a motion sensor and a sound sensor, the sensor selectively activating the music player and blinking light; and a backlighting bulb, located behind the front panel, and wherein the front panel becomes substantially transparent when backlit, wherein the backlighting bulb is selectively activated making the picture within the frame viewable through the front panel.

2. A method of temporarily giving an existing picture frame the appearance of a wrapped gift, said picture frame having a front, a rear, sides, and a window that is defined by a border that extends at a substantially uniform width inwardly from the sides, wherein an existing picture is displayed through the window and is matted by the border, said method utilizing a decorative holiday picture frame cover having a front panel, at least one side panel, a bow affixed to and centered upon the front panel, and a stretchable rear edging extending inwardly from the at least one side panel behind the front panel, said rear edging having a peripheral border, said method comprising the steps of:

covering the picture frame with the picture frame cover by spanning the front panel across the front of the picture frame with the side panels substantially aligned with the sides of the picture frame, and stretching the rear edging so that it extends behind the picture frame, thereby causing the peripheral border of the rear edging to rest flush against the rear of the frame, and the front panel to fit snugly against the frame front without actually affixing or adhering to the picture frame;

removing the picture frame cover from the picture frame after the holiday season, by pulling the cover off the frame, by pulling the front panel upwardly and away from the frame, making the rear edging disengage the picture frame sides; and storing the frame cover until needed for the next holiday season.

3. The method as recited in claim 2, wherein the picture frame cover further has a blinking light positioned in proximity to the bow, a music player, and a motion sensor in communication with the blinking light, wherein the step of covering the picture frame is followed by the step of activating the blinking light and music player by the sensor detecting motion.

4. The method as recited in claim 2, wherein the picture frame cover further has a blinking light positioned in proximity to the bow, a music player, and a sound sensor in communication with the blinking light, wherein the step of covering the picture frame is followed by the step of activating the blinking light and music player by the sound sensor detecting sound.

5. The method as recited in claim 2, wherein the picture frame has a support arm for selectively supporting the frame upon a horizontal surface, wherein the step of covering the picture frame is preceded by the additional step of pivoting the support arm away from the rear of the picture frame, in order that the support arm will not be covered by the rear edging.

6. The method as recited in claim 2, wherein the picture frame cover has a backlighting bulb located behind the front panel, and wherein the step of covering the picture frame is followed by the step of viewing the picture through the front panel by illuminating the backlighting bulb.

* * * * *